US010292469B2

(12) United States Patent
Sijmons et al.

(10) Patent No.: US 10,292,469 B2
(45) Date of Patent: May 21, 2019

(54) LUGGAGE CASE HAVING SURFACE FEATURES PROVIDING ENHANCED CORNER STRENGTH

(71) Applicant: Samsonite IP Holdings S.a r.l., Luxembourg (LU)

(72) Inventors: Erik Sijmons, Oudenaarde (BE); Serge Vanheck, Elversele (BE)

(73) Assignee: Samasonite IP Holdings S.a r.l., Luxembourg (LU)

( * ) Notice: Subject to any disclaimer, the term of this patent is extended or adjusted under 35 U.S.C. 154(b) by 31 days.

(21) Appl. No.: 14/925,451

(22) Filed: Oct. 28, 2015

(65) Prior Publication Data

US 2016/0113366 A1 Apr. 28, 2016

(30) Foreign Application Priority Data

Oct. 28, 2014 (EP) ..... 14190747

(51) Int. Cl.
*A45C 5/02* (2006.01)
*A45C 5/03* (2006.01)
(Continued)

(52) U.S. Cl.
CPC ..... *A45C 5/02* (2013.01); *A45C 5/03* (2013.01); *A45C 5/14* (2013.01); *A45C 13/36* (2013.01);
(Continued)

(58) Field of Classification Search
CPC .. A45C 3/004; A45C 3/02; A45C 5/02; A45C 3/001; A45C 3/00
(Continued)

(56) References Cited

U.S. PATENT DOCUMENTS 1,015,511 A * 1/1912 Romunder ..... A45C 5/02 190/37
1,649,292 A 11/1927 Draper
(Continued)

FOREIGN PATENT DOCUMENTS

CN 202311694 U 7/2012
CN 202566709 C 12/2012
(Continued)

OTHER PUBLICATIONS

Extended European Search Report of corresponding European Patent Application No. 14190747.7 dated Jun. 1, 2015, 5 pages.
(Continued)

*Primary Examiner* — Fenn C Mathew
*Assistant Examiner* — Cynthia F Collado
(74) *Attorney, Agent, or Firm* — Dorsey & Whitney LLP

(57) ABSTRACT

A luggage article having surface features providing enhanced corner strength is provided. The luggage article includes a housing at least partially formed by an outer layer and defining in part a first side, a second side, and a third side. A corner region is defined at the intersection of the first, second, and third sides, and an apex region is defined at least partially by the corner region. The luggage article may also include a first elongated surface feature formed by the outer layer and extending at least partially across one or more of the first, second, and third sides at a first distance spaced away from the apex region and curving relative to the apex region. The luggage article may also include a second elongated surface feature. The first and second surface features may define a curve similar to each other along a portion of their respective length.

19 Claims, 8 Drawing Sheets

(51) Int. Cl.
*A45C 5/14* (2006.01)
*A45C 13/36* (2006.01)

(52) U.S. Cl.
CPC .. *A45C 2005/032* (2013.01); *A45C 2005/037* (2013.01)

(58) Field of Classification Search
USPC ..... D3/276, 273, 279, 281; 220/4.21; 190/124, 100, 18 A, 115, 102
See application file for complete search history.

(56) References Cited

U.S. PATENT DOCUMENTS

| | | | | |
|---|---|---|---|---|
| 1,987,764 | A | 9/1933 | Walker et al. | |
| 2,036,276 | A | 4/1936 | Hothersall | |
| 2,510,643 | A | 6/1950 | Long | |
| 2,950,792 | A | 8/1960 | Axtell | |
| 3,044,215 | A | 7/1962 | Crousore | |
| 3,163,686 | A | 12/1964 | Dusel | |
| 3,251,460 | A | 5/1966 | Edmonds | |
| 3,313,382 | A | 4/1967 | Rosing et al. | |
| D249,234 | S | 9/1978 | Limon et al. | |
| 4,113,095 | A | 9/1978 | Dietz et al. | |
| 4,712,657 | A | 12/1987 | Myers | |
| D299,589 | S | 1/1989 | Uchiyama | |
| 4,803,769 | A | 2/1989 | Gibbs | |
| 6,035,982 | A | 3/2000 | Wei-Chih | |
| 6,131,713 | A | 10/2000 | Sher | |
| 6,345,709 | B1 | 2/2002 | Cheng | |
| D454,430 | S | 3/2002 | Sijmons | |
| 6,627,271 | B1 | 9/2003 | Okazaki | |
| D512,566 | S | 12/2005 | Nuovo et al. | |
| D540,540 | S | 4/2007 | Szyf et al. | |
| 7,293,649 | B2 | 11/2007 | Gelphman et al. | |
| D563,101 | S | 3/2008 | Kuchler et al. | |
| D581,666 | S | 12/2008 | Sijmons | |
| D582,160 | S | 12/2008 | Sijmons | |
| D587,902 | S | 3/2009 | Yoneno | |
| D627,162 | S | 11/2010 | Weng | |
| D629,199 | S | 12/2010 | Minneman | |
| D629,200 | S | 12/2010 | Turella-Yuan et al. | |
| D633,716 | S | 3/2011 | Turella-Yuan et al. | |
| D639,555 | S | 6/2011 | Moon | |
| D642,379 | S | 8/2011 | Buller | |
| D644,434 | S | 9/2011 | Miles et al. | |
| D644,435 | S | 9/2011 | Weng | |
| D659,395 | S | 5/2012 | Sijmons | |
| D665,998 | S | 8/2012 | Sijmons | |
| 8,663,531 | B2 | 3/2014 | De Taeye et al. | |
| D709,696 | S | 7/2014 | Wu | |
| D710,609 | S | 8/2014 | Sijmons | |
| D710,610 | S | 8/2014 | Sijmons et al. | |
| D711,104 | S | 8/2014 | Lai | |
| D711,649 | S | 8/2014 | Chen | |
| 8,800,807 | B2 | 8/2014 | Alvares | |
| D720,928 | S | 1/2015 | Roncato | |
| D722,771 | S | 2/2015 | Wu | |
| D732,823 | S | 6/2015 | Baron | |
| D733,428 | S * | 7/2015 | Sijmons | D3/279 |
| D755,518 | S * | 5/2016 | Sijmons | D3/279 |
| D771,382 | S * | 11/2016 | Maeda | D3/279 |
| 2005/0183579 | A1 | 8/2005 | Bowers | |
| 2007/0012695 | A1* | 1/2007 | Yang | A45C 5/02 220/8 |
| 2007/0164020 | A1* | 7/2007 | Amett | A45C 5/02 220/4.21 |
| 2007/0237920 | A1 | 10/2007 | Schoulz | |
| 2007/0296117 | A1 | 12/2007 | Taeye et al. | |
| 2008/0308568 | A1 | 12/2008 | Grenier et al. | |
| 2010/0259139 | A1* | 10/2010 | Tussy | A45C 5/02 312/213 |
| 2011/0016018 | A1 | 1/2011 | Smith et al. | |
| 2011/0113615 | A1* | 5/2011 | Cho | A45C 5/02 29/527.1 |
| 2011/0127264 | A1 | 6/2011 | Whalen | |
| 2011/0147386 | A1 | 6/2011 | Whalen et al. | |
| 2011/0155526 | A1* | 6/2011 | Cheng | A45C 5/14 190/18 A |
| 2011/0186396 | A1* | 8/2011 | Sheikh | A45C 13/10 190/111 |
| 2011/0284334 | A1* | 11/2011 | Cheng | A45C 5/14 190/18 A |
| 2013/0292221 | A1* | 11/2013 | Ryan | A45C 5/03 190/18 A |
| 2014/0131963 | A1* | 5/2014 | Bengtzen | A45B 23/00 280/32 |
| 2014/0166416 | A1* | 6/2014 | Krulik | A45C 5/02 190/111 |
| 2017/0258190 | A1* | 9/2017 | Salander | A45C 5/03 |
| 2017/0318926 | A1* | 11/2017 | Sijmons | A45C 5/02 |

FOREIGN PATENT DOCUMENTS

| | | | | |
|---|---|---|---|---|
| CN | 202698065 | U | 1/2013 | |
| EM | 000615984-0001 | | 11/2006 | |
| EM | 000945175-0001 | | 6/2008 | |
| EM | 000951454-0001 | | 6/2008 | |
| EM | 001003255-0001 | | 9/2008 | |
| EM | 001045520-0001 | | 11/2008 | |
| EM | 001651191-0001 | | 12/2009 | |
| EM | 001212856-0001 | | 4/2010 | |
| EM | 001236632-0001 | | 9/2010 | |
| EM | 001236632-0002 | | 9/2010 | |
| EM | 001236996-0001 | | 9/2010 | |
| EM | 002344622-0002 | | 11/2013 | |
| EP | 1763430 | B1 | 3/2007 | |
| EP | 2429912 | B1 | 7/2014 | |
| EP | 3015018 | A1 | 5/2016 | |
| GB | 2184940 | A | 7/1987 | |
| GB | 2361692 | A | 12/2003 | |
| JP | 2009262499 | A | 11/2009 | |
| WO | 9305943 | A1 | 4/1993 | |
| WO | WO 9305943 | A1 * | 4/1993 | A45C 5/02 |

OTHER PUBLICATIONS

"McQueen's Quick Silver", Downloaded at http://www.style.com/trends/blogs/style_file/shopping_news/index.html, Jul. 17, 2008, Jul. 17, 2008, 1 Page.

* cited by examiner

LUGGAGE CASE HAVING SURFACE FEATURES PROVIDING ENHANCED CORNER STRENGTH

CROSS-REFERENCE TO RELATED APPLICATION

This application claims priority to European Patent Application No. 14190747.7, filed Oct. 28, 2014, entitled "Luggage Case Having Surface Features Providing Enhanced Corner Strength", which is hereby incorporated by reference herein in its entirety for all purposes.

TECHNICAL FIELD

The present invention relates to luggage articles and, in particular, to enhancements to the shell structure of luggage cases.

BACKGROUND

Luggage cases, in particular hard sided luggage cases, provide tough, protective containers for contents during travel. Given the relatively rigid structure of a hard sided luggage case, certain portions are more susceptible to large impact loads, and thus damage, when being transferred by baggage handlers and others during a journey. One such area subject to significant impact loads is the corner region. Because of its high degree of curvature, and correspondingly reduced surface area to absorb an impact, the corner region is subject to greatly magnified loads when impacted on the corner, for instance when dropped. Previous attempts to mitigate this effect have included adding additional layers to the corner to increase the structural strength of the luggage case, thickening the material cross section of the hard sided formed layer in the corner regions, and others.

As the efforts continue to accelerate the use ever lighter-weight materials in the construction of hard sided luggage, the addition of more or thicker layers at the corners to combat this problem are becoming less acceptable.

Documents that may be related to the present disclosure in that they include various approaches to the formation of surface features on luggage cases include EP2429912, EP1763430, U.S. Pat. No. 3,313,382, U.S. D665,998, U.S. Pat. No. 1,649,292, U.S. D5,152,566, U.S. Pat. No. 4,113,095, U.S. D429,234, U.S. D299,589, U.S. D633 716, U.S. Pat. Nos. 3,251,460, 4,712,657, 2,036,276, 2,950,792, U.S. D644,435, U.S. Pat. Nos. 3,163,686, 2,510,643, U.S. D659,395, U.S. D627,162, U.S. D710,608, U.S. D710,609, U.S. Pat. No. 1,987,764, GB2184940, GB2361692, JP2009262499, U.S. Pat. Nos. 6,131,713, 6,035,982, and 4,803,769. These proposals, however, may be improved.

It is therefore desirable to provide an improved luggage article or case, and in particular an improved luggage shell design, that can absorb and disperse an impact force applied to the luggage case to reduce the risk of damage, such as by permanent deformation.

SUMMARY

According to the present invention there is therefore provided a luggage case having surface features providing enhanced corner strength as described in the accompanying claims.

The present disclosure in particular provides an improved shell structure for a luggage article that can absorb and disperse the energy of an impact such that the shell absorbs the impact force and is resistant to permanent deformation. The shell includes surface features, such as ribs and/or grooves, formed in a pattern to provide this increased shock dispersion. The surface features may be formed in a higher density in and around one or more corner regions of the luggage article, and also may be formed in a lower density when positioned a distance away from corner regions, such as in the central area of a major face of the luggage article, in order to mitigate or lessen the impact force as the force transmits through the luggage shell. The surface features may be more concentrated in and around the corner regions and less concentrated with distance away from the corner regions. The vertical dimension and width of the surface features may also be deeper and narrower, respectively, near the corner regions and shallower and wider, respectively, at locations spaced away from the corner regions. The surface features may be positioned perpendicular to a vector of impact force applied at the corner region of the luggage article.

In an example, a luggage article having surface features providing enhanced corner strength is provided. The luggage article includes a housing at least partially formed by an outer layer and defining in part a first side, a second side, and a third side. A corner region is defined at or near the intersection of the first, second, and third sides or panels, and an apex region is defined at least partially by the corner region. The luggage article may also include a first elongated surface feature formed by the outer layer and extending at least partially across one or more of the first, second, and third sides at a first distance spaced away from the apex region and curving relative to the apex region. The luggage article may also include a second elongated surface feature formed by the outer layer and extending at least partially across one or more of the first, second, and third sides at a second distance spaced away from the apex region and curving relative to the apex region. In some examples, each of the first and second surface features define a curve similar to each other along a portion of their respective lengths. In other examples, the first and second surface features may define height and width dimensions, with the height dimension and width dimension of the surface feature closer to the apex region being larger and narrower, respectively, relative to the surface feature spaced further from the apex region.

In some embodiments, the housing of the luggage article includes first and second portions selectively secured together at a line of closure. In some examples, the first portion is formed at least partially by the outer layer.

In some embodiments, the second surface feature is spaced further away from the apex region than the first surface feature.

In some embodiments, the first surface feature has a width and the second surface feature has a width. In some examples, the width of the surface feature positioned further from the apex region is greater than the width of the surface feature positioned closer to the apex region.

In some embodiments, the first surface feature has a height dimension and the second surface feature has a height dimension. In some examples, the height dimension of the surface feature positioned further from the apex region is less than the height dimension of the surface feature positioned closer to the apex region.

In some embodiments, the first surface feature includes another first surface feature and the second surface feature includes another second surface feature. In some examples, the spacing between the first surface feature and the another first surface feature are multiples less than the spacing between the second surface feature and the another second surface feature.

In some embodiments, a plurality of first surface features have a density, and the plurality of second surface features has a density. In some examples, the density of the second surface features positioned further from the apex region is less than the density of the first surface features positioned closer to the apex region.

In some embodiments, at least one of the first surface feature and the second surface feature extends across at least two of the first, second and third sides of the housing.

In some embodiments, at least one of the first surface feature and the second surface feature extends at least partially at generally right angles to the line of closure.

In some embodiments, the first surface feature and the second surface feature include a rib, or include a groove.

In some embodiments, the first surface feature is defined by a surface feature set, and the second surface feature is defined by a second surface feature set.

In some embodiments, the first surface feature and the second surface feature curve concave toward, convex away, or in opposite directions relative to the apex region.

In some embodiments, one of the first surface feature or the second surface feature extends along but spaced away from an edge formed by the intersection of any two of the first, second, or third sides.

In some embodiments, one of the first surface feature and the second surface feature extends for at least a portion of its length across at least one of the first, second, or third sides in a direction diagonal relative to the corner region.

In some embodiments, portions of one of the first or second surface features extend in a direction substantially perpendicular to a component line of an impact force applied at the apex region.

In some embodiments, the component line lies in a range of angles measured from a line extending from an upper corner diagonally to a lower corner together formed on a same side, and including a deviation of approximately 10 degrees towards a short side of the housing adjacent the upper corner, and including a deviation of 20 degrees towards a long side of the housing adjacent the upper corner.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various embodiments of the disclosure and should not be construed as a complete recitation of the scope of the disclosure, characterized in that.

DETAILED DESCRIPTION

Figure 1:
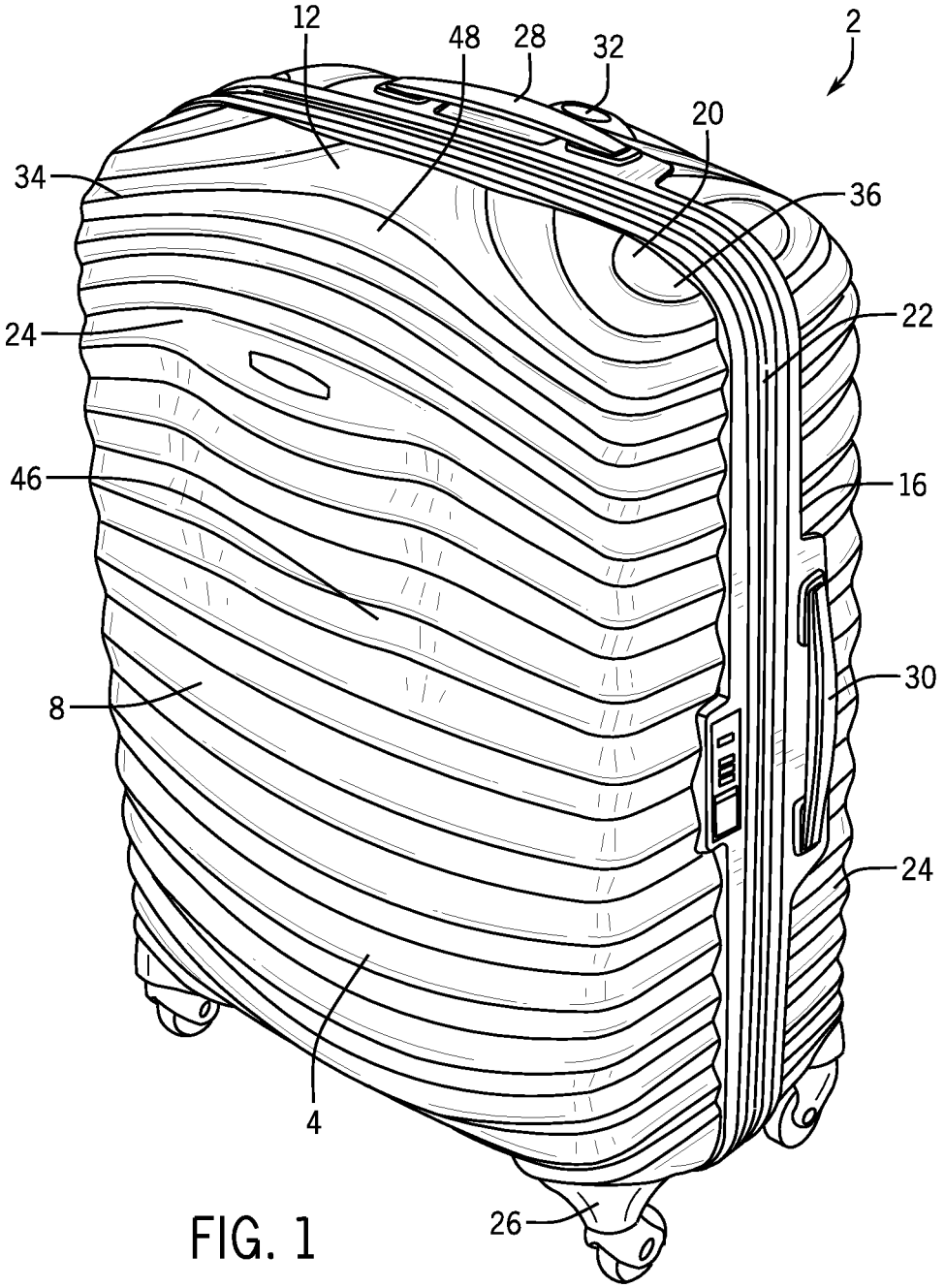
FIG. 1 is an isometric view a luggage case in accordance with some examples of the present disclosure.

The present disclosure provides an improved shell structure for a luggage article. In particular, the present disclosure provides a shell structure that can absorb and disperse shock induced energy during a large impact such that the shell absorbs the impact and is resistant to permanent deformation. In general, the shell includes surface features, such as ribs and/or grooves, formed in a pattern to provide increased shock dispersion. In some examples, the surface features may be formed in a higher density in and around one or more corner regions of the luggage article, and also may be formed in a lower density when positioned a distance away from corner regions, such as in the central area of a major face of the luggage article, in order to mitigate or lessen the impact force as the force transmits through the luggage shell. In like manner, the vertical dimension and width of the surface features may be more concentrated in and around the corner regions and less concentrated with distance away from the corner regions. In some examples, the vertical dimension and width of the surface features may be deeper and narrower, respectively, near the corner regions and shallower and wider away from the corner regions. In some examples, the surface features may be positioned perpendicular to a vector of impact force on the luggage article.

Referring to FIGS. 1-3A, a hard sided luggage case 2 is defined by a housing 4 formed by an outer layer 6, and includes a front panel 8, a rear panel 10, a top panel 12, a bottom panel 14, a right side panel 16, and a left side panel 18. Corner regions 20 are defined by the intersection of any two or three adjacent panels 8, 10, 12, 14, 16, 18. For example, the luggage case 2 includes four upper corner regions and four lower corner regions, each formed by the intersection of three adjacent panels. Additionally, the edges formed by the intersection of any two adjacent panels may also be considered a "corner region." The panels 8, 10, 12, 14, 16, 18 as described herein may also be referred to as "sides." Thus, a first side, a second side, and/or a third side of the luggage case 2 may each be any of the various panels 8, 10, 12, 14, 16, 18 described herein. The luggage case 2 may also include a closure mechanism, such as a zipper, that extends along the central portions of the side panels 16, 18 and the top and bottom panels 12, 14, and defines a line of closure 22, which divides the luggage case 2 into two shell portions 24. A hinge (not shown) for pivotally connecting the two shell portions 24 together is positioned along the line of closure 22. The zipper can be unzipped to allow the two shell portions 24 to pivot about the hinge portion to allow access to the interior. Various types of closure mechanisms and hinge structures are acceptable. The luggage case 2 also preferably includes four spinner type wheels 26 as shown, or may include other wheel or support structures, to allow the user to pull or tow the luggage case 2 at an angle, or to guide it along in an upright position. The luggage case 2 may include a top carry handle 28 on the top panel 12 and a side carry handle 30 on a side panel 16, 18. The luggage case 2 may also include an extendable pull handle 32. The pull handle 32 may be aligned along the outside of the rear panel 10 of the luggage case 2. Alternatively, the pull handle 32 may also be aligned along the rear panel 10 but positioned inside the luggage case 2. While described herein with reference to a hard sided luggage case 2 having spinner wheels 26, the improvements described herein may also be advantageously implemented on other types of luggage, including soft side cases, hybrid cases, backpacks, and duffle bags.

With continued reference to FIGS. 1-3A, each of the two shell portions 24 of the luggage case 2 may include surface features 34 formed by the outer layer 6 of the luggage case housing 4. The surface features 34 increase the strength and resilience of the luggage shells 24 by providing improved impact resistance when the luggage case 2 is impacted. Generally, impact forces are most harmful on the corner regions 20. Corner regions 20 are subject to impact forces, for instance, when the luggage case 2 is dropped on a corner region. Each corner region 20 may at least partially define an apex region 36 wherein an impact force F may induce the greatest shock energy into the luggage case 2. Impact forces F are applied along a direction or vector, and the impact force F travels through the outer layer 6 along a component line CL consistent with the vector, such as that shown in FIGS. 1-3. The apex region 36 may be also be defined by an edge, or part of an edge, formed between two of the various panels 8, 10, 12, 14, 16, 18.

As an example of the surface features 34, FIGS. 1-3A disclose a plurality of surface features 34 forming a substantially ripple-shaped outer layer 6, extending generally in a curved shape around the corner regions 20, and generally normal to the vector of (or component line CL of) the impact force F. The substantially ripple-shaped surface features 34 may be configured to substantially absorb energy from an impact force F by dispersing through resilient deformation between the surface features 34. In this way the shock energy is dissipated through at least the portion of the shell 24 where the surface features 34 are formed. The surface features 34 reduce the likelihood of permanent deformation of the corner regions 20.

The surface features described herein may also be formed in a laminate of more than one layer, and may include, for example, an inner layer and an outer layer, or an inner layer, outer layer, and intermediate layer. The layer(s) may be moldable hard side material, or a combination of hard side material and soft side material(s). The hard side material may be a thermoplastic material (self-reinforced or fiber reinforced), ABS, polycarbonate, polypropylene, polystyrene, PVC, polyamide, PTFE, among others. The luggage case may be formed or molded in any suitable manner, such as by plug molding, blow molding, injection molding, or the like. Additionally, the thickness of the layer in which the surface feature is formed may be as low as approximately 0.8 mm or less, and up to approximately 3 mm or more, and preferably may be in the range of 1 to 2.5 mm, and even more preferably in the range of 1 to 2 mm. The thickness of the layer or layers in which the surface features are formed may be consistent, or may vary, across a section of the surface feature. Varying the thickness may affect the ability of the surface feature to absorb the impact force, allowing the dimensions of the surface features to be designed particularly for the expected impact forces for the size of the luggage and its intended use. For instance, the thickness at the bottom of a groove or at the top of a peak may be greater than the sections extending there between. Alternatively, the bottom of a groove or the tip of a peak may be thinner than the sections extending there between.

As shown in FIGS. 1-3A, the surface features 34 extend at least partially across at least one of the panels 8, 10, 12, 14, 16, 18 and curve relative to the apex region 36 to disperse the impact force F away from the apex region 36. The surface features 34 are positioned close to the apex region 36, and radiate away from the apex region 36 in a relatively continuous set of ripples. Each adjacent surface feature may generally extend along a similar curve as its adjacent surface feature. The curvature of each individual surface feature 34 may be different from its adjacent surface features (on either side).

Figure 3:
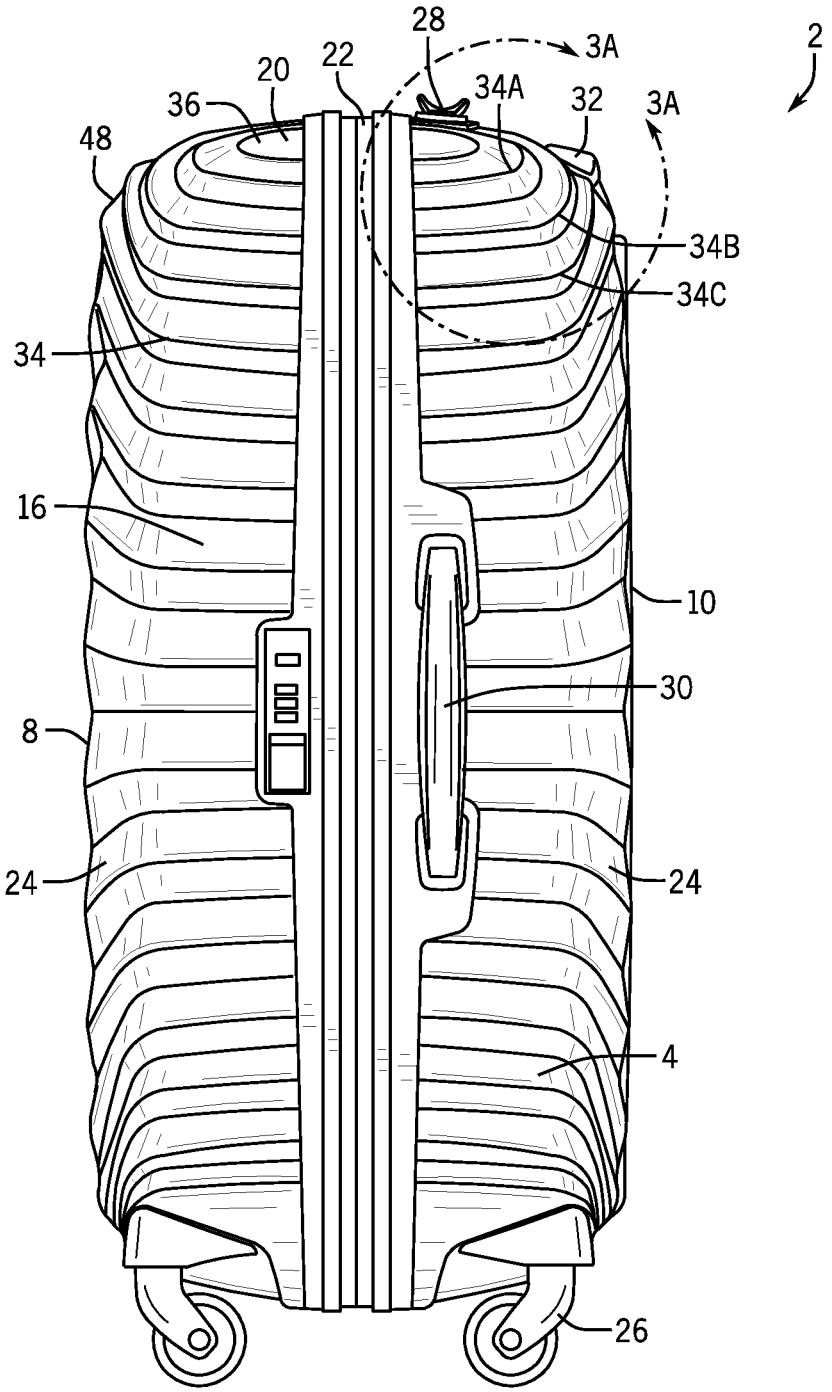
FIG. 3 is a right elevation view of the luggage case of FIG. 1.
Figure 3A:
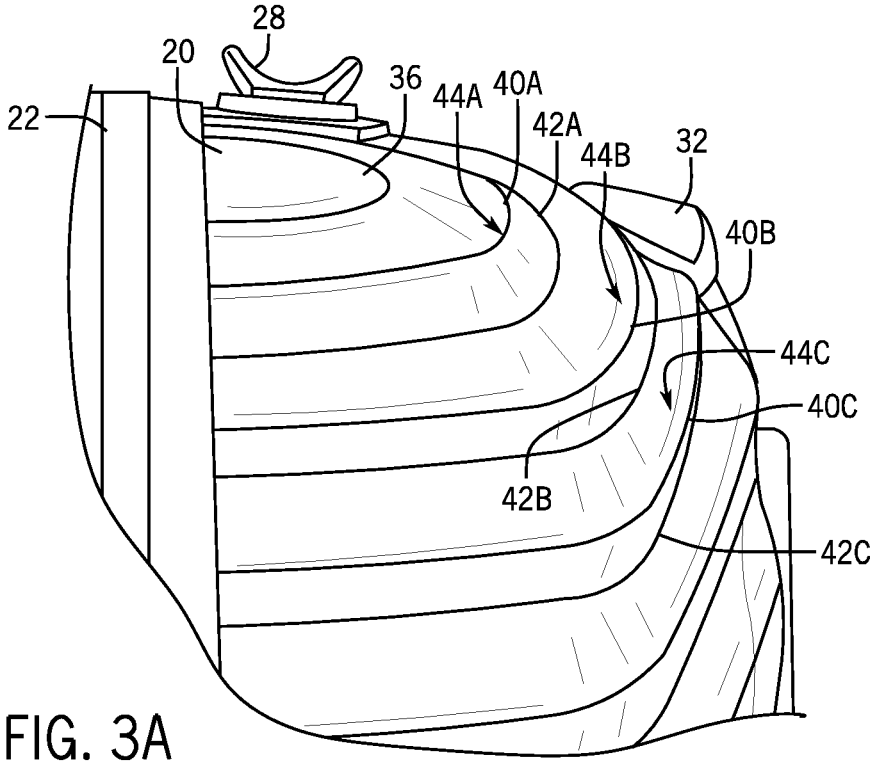
FIG. 3A is an enlarged fragmentary view of Detail 3A of FIG. 3.
Figure 4:
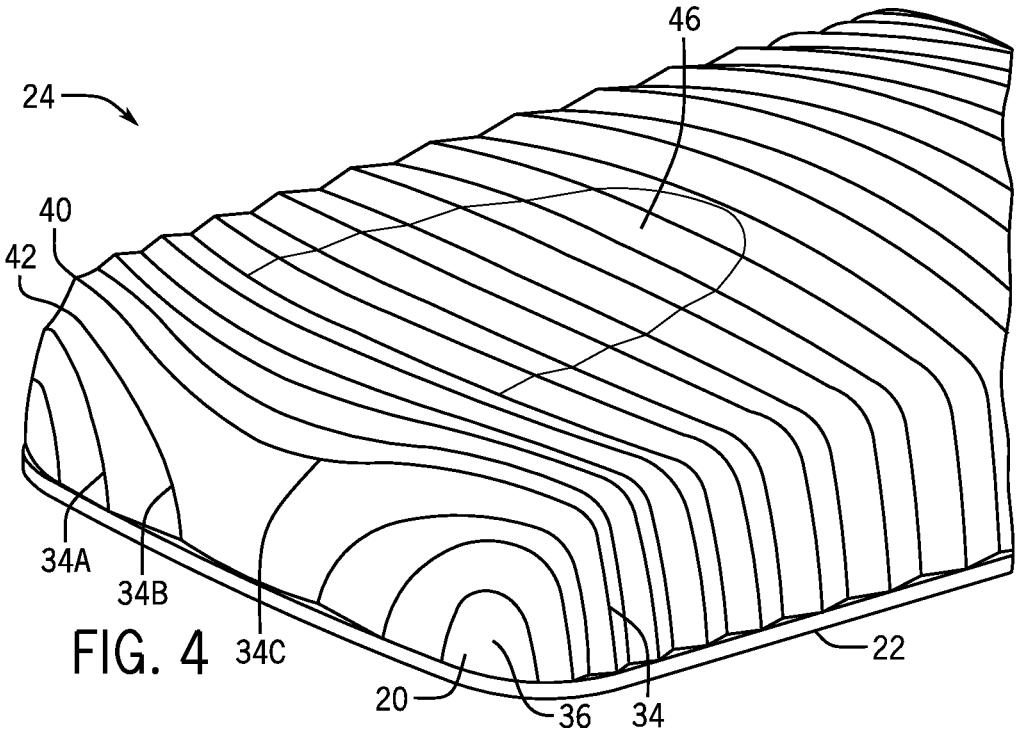
FIG. 4 is a fragmentary isometric view of a luggage shell in accordance with some examples of the present disclosure.
Figure 5:
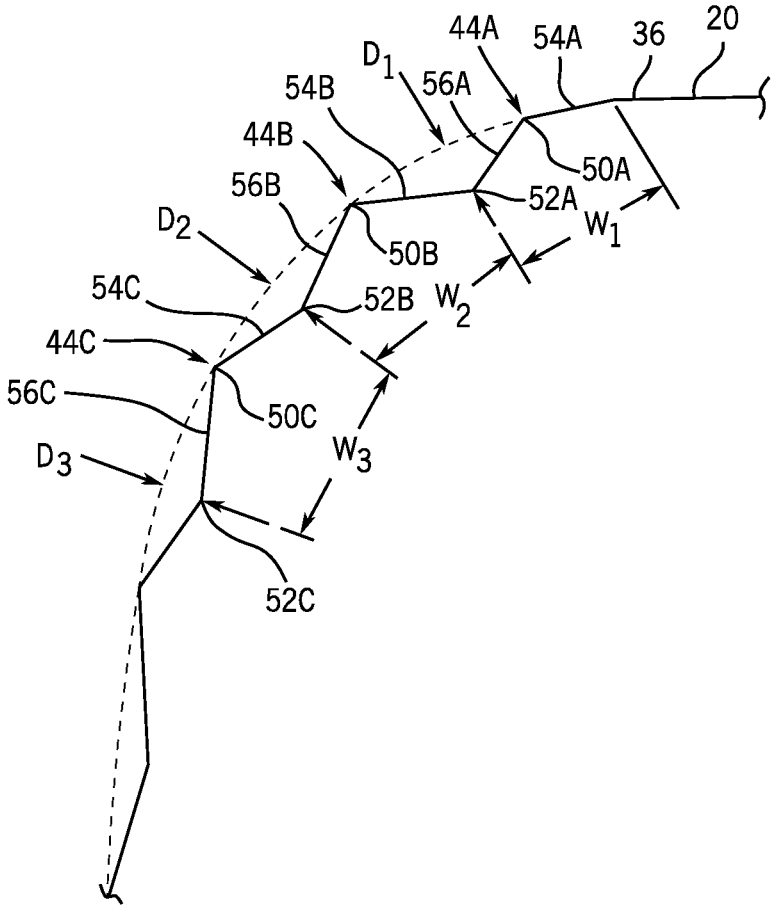
FIG. 5 is a representative fragmentary cross-sectional view of the surface features formed by the outer layer of a luggage case taken along line 5-5 of FIG. 1.

With reference to FIGS. 3A, 4 and 5, an individual "surface feature" 34 is formed by one rib 40, one groove 42, or a combination of one rib 40 and one adjacent groove 42. Where the surface feature 34 is a rib 40, the adjacent surface feature is defined by the adjacent groove, or the next adjacent rib (skipping over the intervening groove). Where the surface feature 34 is a groove 42, the adjacent surface feature is defined by the adjacent rib, or the next adjacent groove (skipping over the intervening rib). A "surface feature set" 44 is formed by the combination of a rib 40 and an adjacent groove 42. A second surface feature set 44B is a different rib and an adjacent groove. A third surface feature set 44C may be similarly configured, and so on.

Each individual surface feature 34 defines a width dimension W, a height dimension H, and a length (or extension) dimension L. Where the individual surface feature 34 is a rib 40, the width dimension W is measured from the bottom of the adjacent groove on one side to the bottom of the adjacent groove on the opposite side. Where the individual surface feature 34 is a groove 42, its width dimension W is measured from the top of the adjacent rib on one side to the top of the adjacent rib on the other side. Where the surface feature 34 is a rib 40, the height dimension H is measured in a direction extending away from the luggage case 2. Where the individual surface feature 34 is a groove 42, the height dimension H is measured in a direction extending into the luggage case 2. The length dimension L is measured along the generally longitudinal direction along which the rib 40 or groove 42 extends. The width and height dimensions W, H of a surface feature 34 may vary along its length L, and may be the same as or different from the adjacent ribs or grooves. The description below associated with FIG. 5 details the measurement of the height and width dimensions H, W, and relative changes thereto, for surface feature sets 44. The proportion of the width W of the rib 40 and width W of the groove 42 may change along the length L; while the overall width $W_O$ of the surface feature set 44 may stay relatively consistent along its length L. Or, the overall width $W_O$ of the surface feature set 44 (made up of the width W of the rib 40 and the width W of the groove 42) may vary along its length L, and may be the same as or different from the adjacent surface feature sets. The respective height of the rib 40 or depth of the groove 42 of the surface feature set 44 may vary along its length L. Generally, for a given material thickness, the larger the height dimension H and smaller the width dimension W of a surface feature 34 or surface feature set 44, the more resilient the surface feature 34 or surface feature set 44 is for absorbing and dissipating the impact force F. The smaller the height dimension H and the larger the width dimension W, the less absorptive and resilient the surface feature 34 or surface feature set 44. A change in each of the height or width dimension H, W alone without the other, relative to the distance from the apex region 36, may be implemented. Each by itself has an effect on absorptive and resilient properties, and may be implemented separately from the other.

As noted above and more fully explained below, the surface features 34 positioned near the apex regions 36 may have a narrower width dimension W and larger height dimension H, and thus are more densely positioned. As the distance from the apex regions 36 increases, the height dimension H of the surface feature 34 generally decreases, and the width dimension W of the surface feature 34 generally increases. These dimensional changes result in a visual effect of the surface features 34 dissipating as they radiate away from the apex region 36, akin to the ripple effect of a pebble impacting water. More densely-spaced surface features 34 provide a generally greater resilience to impact forces F near the apex region 36 where needed, and create less likelihood of permanent deformation. The surface features 34 may be less densely packed at locations spaced away from the apex region 36 because the impact force F has been dissipated or attenuated by the time it reaches these more remote regions and less resilience is needed. The aspects of the surface features 34 described in this paragraph apply equally to a surface feature set 44.

Figure 2:
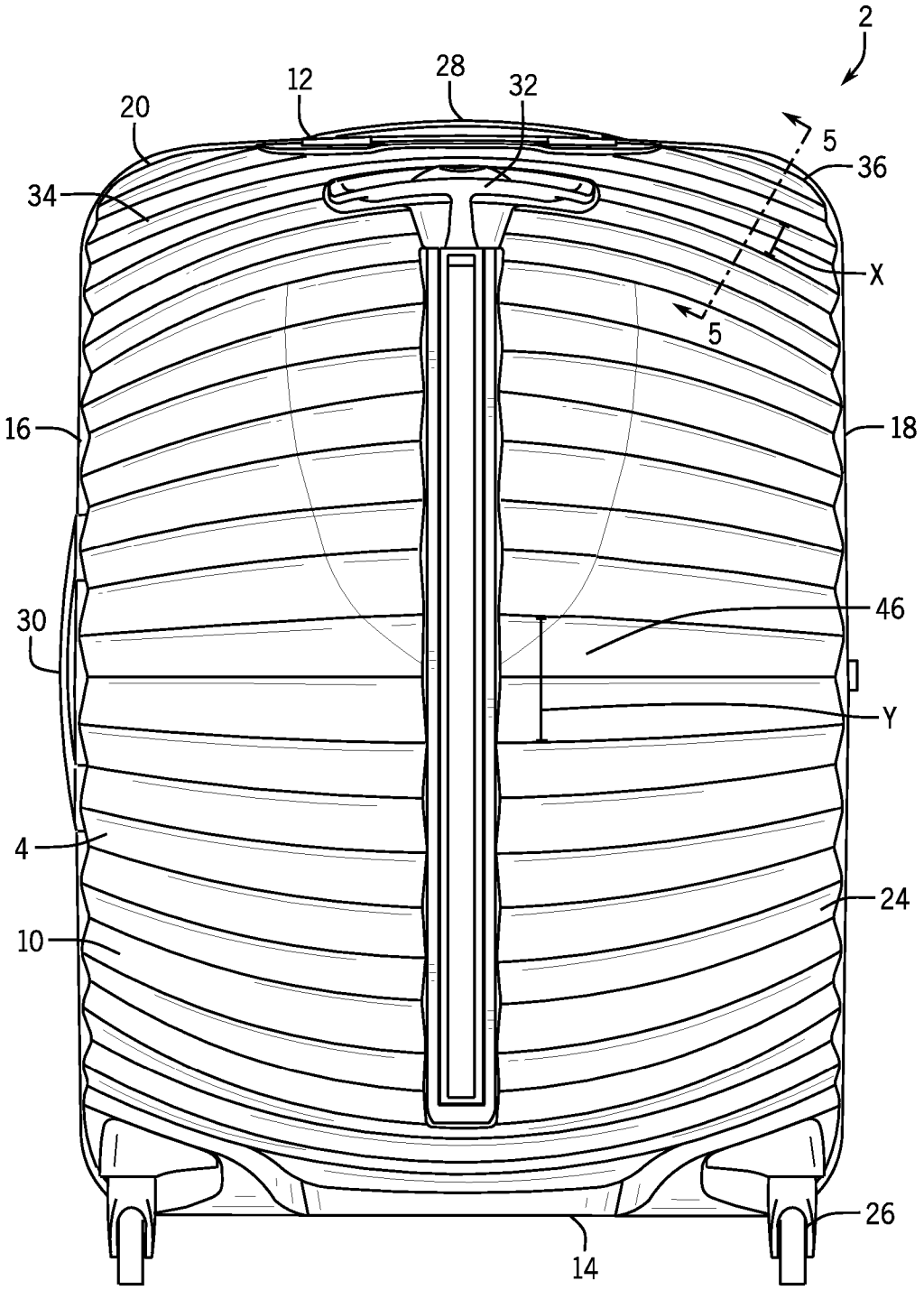
FIG. 2 is a rear elevation view of the luggage case of FIG. 1.

As an example of the spacing, and continuing to refer to FIGS. 2, 4 and 5, the surface features 34 may be positioned 2 to 3.5 times closer to each other near the apex region 36 compared to the interior field 46 of the front and rear panels 8, 10. Other larger or smaller spacing ratios are acceptable. For example, and with reference to FIG. 2, for a shell 24 having a height of 700 mm, the distance X between the surface features 34 near the apex region 36 may vary between 10 mm and 12 mm, whereas the distance Y between the surface features 34 further from the apex region 36, for instance within the interior field 46 of the front and rear panels 8, 10, may vary between 30 mm and 35 mm. In still other examples, the surface features 34 may gradually disappear entirely within the interior field 46 of the front and rear panels 8, 10. The aspects of the surface features 34 described in this paragraph apply equally to a surface feature set 44.

With reference to FIGS. 1, 3, and 4, a first elongated surface feature 34A (or surface feature set 44A) extends at least partially across the front and rear panels 8, 10 at a first distance spaced away from the apex region 36, and curves relative to the apex region 36. A second elongated surface feature 34B (or surface feature set 44B) extends at least partially across the front and rear panels 8, 10 at a second distance spaced away from the apex region 36, and curves relative to the apex region 36. In other embodiments, the shell portions 24 may include at least one third elongated surface feature 34C (or surface feature set 44C) extending at least partially across the front and rear panels 8, 10 at a third distance spaced away from the apex region 36, and curving relative to the apex region 36. In some examples, the first surface feature 34A (or surface feature set 44A) has a larger height dimension H and smaller width dimension W than the second surface feature 34B (or surface feature set 44B), and the second surface feature 34B (or surface feature set 44B) has a larger height dimension H and smaller width dimension W than the third surface feature 34C (or surface feature set 44C). Additionally, the second distance from the apex region 36 may be greater than the first distance from the apex region 36, and the third distance from the apex region 36 may be greater than both the second distance and the first distance from the apex region 36. In some examples, the first surface feature 34A (or surface feature set 44A), the second surface feature 34B (or surface feature set 44B), and/or the third surface feature 34C (or surface feature set 44C) may be adjacent the corner region 20.

The shell portions 24 may contain at least two surface features 34 (or surface feature sets 44); however, the shell portions 24 may include any number of surface features 34 (or surface feature sets 44) limited only by the size and dimensions of the particular luggage case 2. For example, the shell portions 24 may include three to six surface features 34 (or surface feature sets 44). It should be noted that while the above was described relative to a major face panel (front or rear panels 8, 10), it is contemplated that the same or similar surface feature or surface feature set layout may be implemented on any of the panels 8, 10, 12, 14, 16, 18 of the luggage case 2.

Referring still to FIGS. 1, 3 and 4, different portions of the length L of a surface feature 34 or surface feature set 44 may curve differently relative to an apex region 36. For example, portions of a surface feature 34 or surface features set 44 curve toward the apex region 36 (concave towards), while other portions of the same surface feature 34 or surface feature set 44 curve away from the apex region 36 (convex away). Similarly, one surface feature 34 or surface feature set 44 may curve concave toward the apex region 36, while an adjacent or other surface feature 34 or surface feature set 44 curves convex away from the apex region 36. The curvature of the surface feature 34 or surface feature set 44 relative to the apex region 36 affects the absorptive and resilience characteristics of the surface feature 34 or surface feature set 44. For instance, where adjacent surface features are both curved concave toward the apex region 36, the surface features 34 together will be relatively more resilient and absorptive, all else equal, than another example of adjacent surface features 34 where one is curved concave toward and the other is curved convex away the apex region 36.

Referring to FIGS. 1-3A, the first surface feature 34A may have a first length $L_1$ and the second surface feature 34B may have a second length $L_2$. In some examples, the second length $L_2$ may be greater than the first length $L_1$. In some examples, the first surface feature 34A and the second surface feature 34B may extend for at least a portion of their lengths $L_1$, $L_2$ substantially parallel to an edge 48 formed between two of the panels 8, 10, 12, 14, 16, 18. In some examples, the first surface feature 34A and the second surface feature 34B may extend for at least a portion of their lengths $L_1$, $L_2$ at an angle diagonal to the corner region 20. In some examples, the first surface feature 34A and the second surface feature 34B may extend for at least a portion of their lengths $L_1$, $L_2$ substantially perpendicular to the line of closure 22 of the luggage case 2. While described above relative to an individual surface feature 34, surface feature sets 44 may also have the same characteristics.

With reference to FIGS. 1, 3A and 5, as noted above, a rib 40 and an adjacent groove 42 combine to form a surface feature set 44. As shown in FIGS. 3A and 5, each of the shell portions 24 may include a first surface feature set 44A having a first rib 40A and a first adjacent groove 42A, a second surface feature set 44B having a second rib 40B and a second adjacent groove 42B, and a third surface feature set 44C having a third rib 40C and a third adjacent groove 42C. The transitions between ribs 40 and grooves 42 may be angular as shown, which aids in the resilience and flexibility of the surface features 34 in response to the impact force F. In some examples, however, the transitions between the ribs 40 and grooves 42 may be smooth, which may generally increase the stiffness of the surface features 34 in response to the impact force F. The first, second, and third surface feature sets 44A, 44B, 44C may or may not be adjacent one another.

Continuing with reference to FIG. 5, the top extent of the first surface feature set 44A may include a first ridge 50A, the top extent of the second surface feature set 44B may include a second ridge 50B, and the top extent of the third surface feature set 44C may include a third ridge 50C. The bottom extent of the first surface feature set 44A may include a first bottom 52A, the bottom extent of the second surface feature set 44B may include a second bottom 52B, and the bottom extent of the third surface feature set 44C may include a third bottom 52C. A first rib segment 54A may connect the apex region 36 to the first ridge 50A, and a first groove segment 56A may connect the first ridge 50A with the first bottom 52A. A second rib segment 54B may connect the first bottom 52A to the second ridge 50B, and a second groove segment 56B may connect the second ridge 50B with the second bottom 52B. Similarly, a third rib segment 54C may connect the second bottom 52B to the third ridge 50C, and a third groove segment 56C may connect the third ridge 50C with the third bottom 52C, and so on. The first surface feature set 44A may include the first rib segment 54A, the first ridge 50A, the first groove segment 56A, and the first bottom 52A. The second surface feature set 44B may include the second rib segment 54B, the second ridge 50B, the second groove segment 56B, and the second bottom 52B. Similarly, the third surface feature 44C set may include the third rib segment 54C, the third ridge 50C, the third groove segment 56C, and the third bottom 52B.

With reference to FIG. 5, the first, second, and third ridges 50A, 50B, 50C may define a nominal curve used to define a depth $D_1$, $D_2$, $D_3$ for each of the first, second, and third adjacent grooves 42A, 42B, 42C. In some examples, the depth $D_1$ of the first adjacent groove 42A may be greater than the depth $D_2$ of the second adjacent groove 42B. Likewise, the depth $D_2$ of the second adjacent groove 42B may be greater than the depth $D_3$ of the third adjacent groove 42C. In some examples, the depths $D_1$, $D_2$, $D_3$ of the adjacent grooves 42A, 42B, 42C may be greater near the corner regions 20, and the depths $D_1$, $D_2$, $D_3$ may decrease as the distance from the corner regions 20 increases. In some examples, the depths $D_1$, $D_2$, $D_3$ of the adjacent grooves 42A, 42B, 42C may vary along the lengths L of the surface features 34. Such configurations have the advantage of better absorbing shock energy induced on the luggage case 2 substantially near the apex region 36 by an impact force F than previous designs. The maximum depth of the grooves 42 may vary from 2.5 mm to 6 mm, with an optimal depth of 5 mm in some examples. In some examples, the depths $D_1$, $D_2$, $D_3$ of the adjacent grooves 42A, 42B, 42C may decrease with distance away from the apex region 36. In alternate embodiments, the depths $D_1$, $D_2$, $D_3$ of the adjacent grooves 42A, 42B, 42C may alternate from less deep to more deep.

As explained above, the width W of the surface features 34 may vary to disperse impact force energy throughout portions of the shell 24. Referring to FIG. 5, the first surface feature 34A may have a first width $W_1$, the second surface feature 34B may have a second width $W_2$, and the third surface feature 34C, if included, may have a third width $W_3$. As shown in FIG. 5, the third width $W_3$ may be greater than the second width $W_2$, and the second width $W_2$ may be greater than the first width $W_1$. In some examples, the width W of the surface features 34 may increase as the distance from the apex regions 36 increases. For example, the width W of the surface features 34 may be relatively narrower near the apex region 36 and relatively wide with distance away from the apex region 36. In some examples, the widths W of the surface features 34 may alternate from narrower to wider. While described above relative to an individual surface feature 34, surface feature sets 44 may also have the same characteristics.

Figure 6:
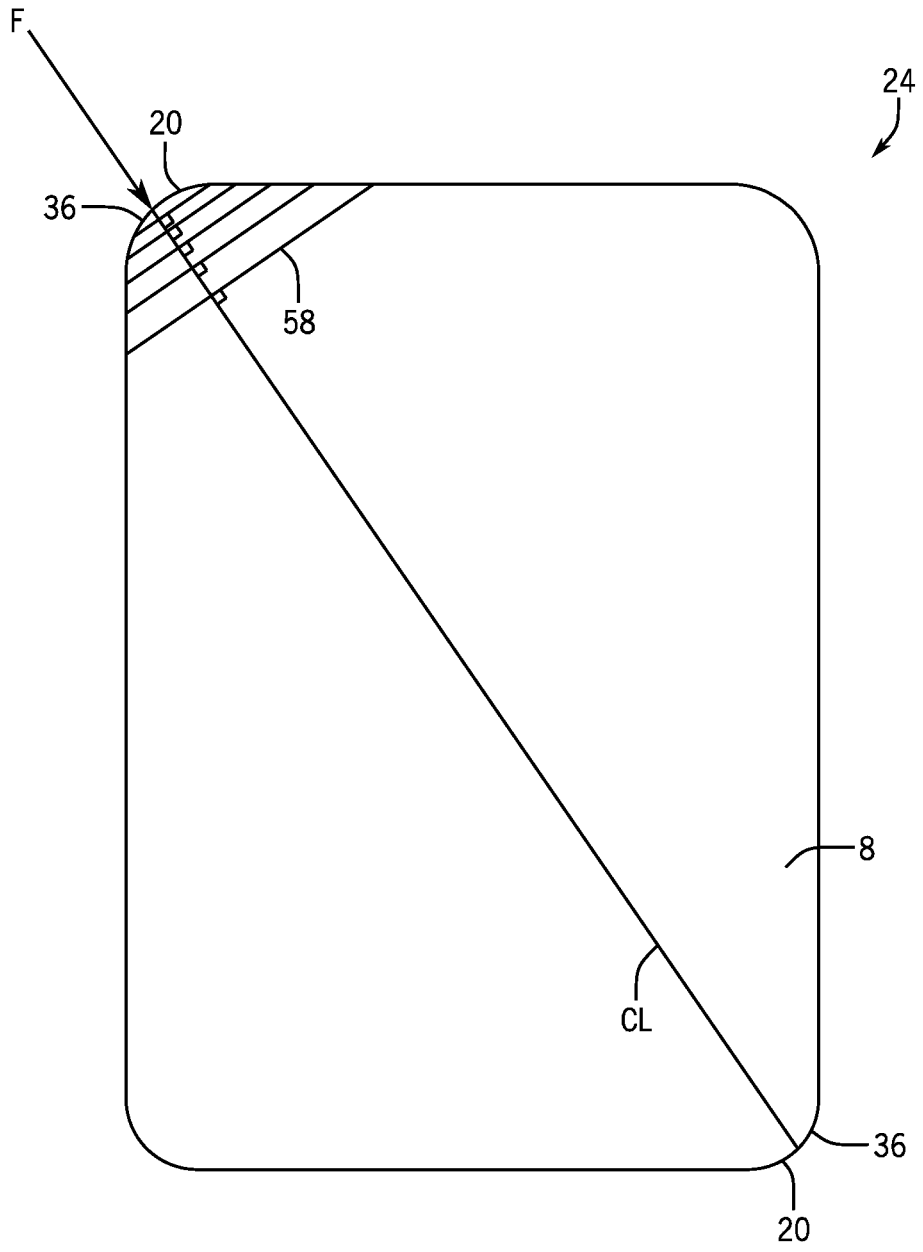
FIG. 6 is a representative schematic elevation view of a luggage case in accordance with some examples of the present disclosure.
Figure 7:
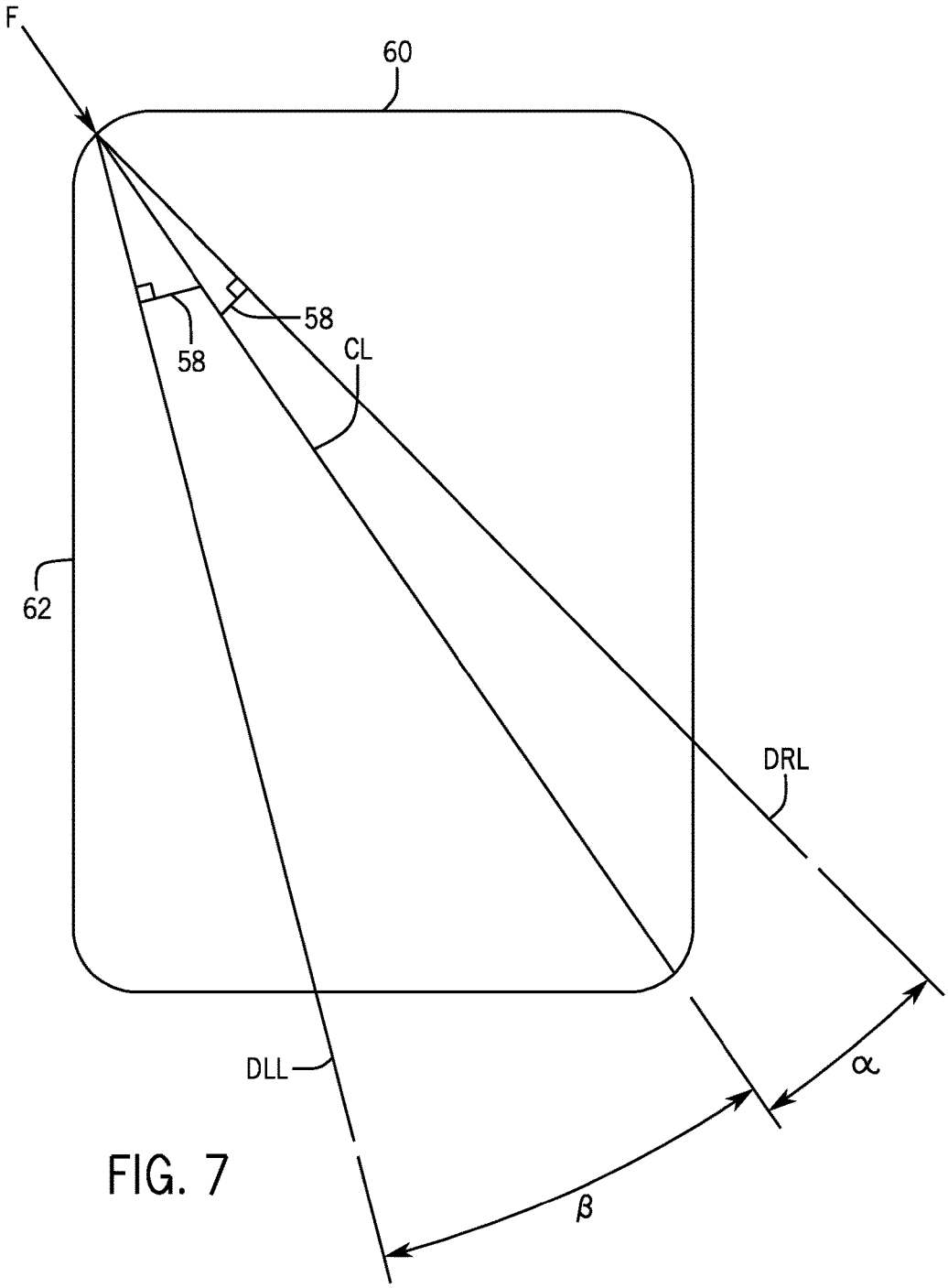
FIG. 7 is a representative schematic elevation view of a luggage case in accordance with some examples of the present disclosure.

The angle of incidence of the impact force F on the apex region 36 may vary widely. It will almost always result in a compressive force being applied in a component vector in the plane of the panels 8, 10, 12, 14, 16, 18 of the luggage case 2. The impact force F will also result in bending loads due to component force vectors out of the plane of the luggage case panels 8, 10, 12, 14, 16, 18. The surface features 34 are believed to enhance the absorption of the bending forces too; however, the discussion below primarily addresses compressive forces in the plane of the panels 8, 10, 12, 14, 16, 18 of the luggage case 2. The description below is with respect to the major face panel (front or rear panels 8, 10) of the luggage case 2. Referring to FIGS. 6 and 7, the surface features 34, or portions thereof, may be oriented perpendicularly to a vector of impact force F as described above. FIG. 6 shows one schematic example of the orientation of the surface features 34 relative to a component line CL of the impact force F. The component line CL is a force vector of impact force F applied at the apex region 36 and in the plane of the panels 8, 10, 12, 14, 16, 18 of the luggage case. It is generally defined, in FIG. 6, as a line connecting opposite corner regions 20 and oriented within the plane of FIG. 6 (which is generally in the plane of the major front or rear panel 8, 10 of the luggage case 2). For example, as shown in FIGS. 6 and 7, the component line CL diagonally bisects the luggage case 2 along the front panel 8 from a top left apex region 36 to a bottom right apex region 36. With reference to FIG. 6, a schematic representation of a plurality of surface features 34 show that they extend substantially perpendicular to the component line CL of the impact force F applied at the apex region 36. This relative orientation between impact force F and surface features 34 maximizes the effect of the surface feature impact dissipation because the majority of, if not virtually all, the impact force F is in a direction designed to compress the surface features 34 to take advantage of their flexible and resilient absorption properties.

Referring now to FIG. 7, although it is desired that the surface features 34 extend in a perpendicular relationship with the component line CL of the impact force F, the surface features 34 may deviate somewhat from the preferred orientation while still being sufficiently absorptive of the impact force F. For example, the length of extension 58 of the surface features 34 may deviate by an angle $\alpha$ toward a short side 60 of a shell 24 from being perpendicular to the component line CL. In other words, the surface features 34 may deviate from being perpendicular to the component line CL, to instead being perpendicular to the deviated right line DRL. The angle between the component line CL and the deviated right line DRL is $\alpha$. Similarly, for example, the length of extension 58 of the surface features 34 may deviate by an angle β toward a long side 62 of a shell 24 from being perpendicular to the component line CL. In other words, the surface features 34 may deviate from being perpendicular to the component line CL, to instead being perpendicular to the deviated left line DLL. The angle between the component line CL and the deviated left line DLL is β. Angle α may be less than or equal to 10 degrees, and angle β may be less than or equal to 20 degrees and still allow the surface features 34 to provide significant absorption of impact forces. Angles α, β greater than 10 and 20 degrees, respectively, are also acceptable for some degree of impact absorption. This permitted variation allows for designing curvature into the surface feature lengths of extension 58 to facilitate a wider variety of impact force angles, as well as permitting flexibility in the resulting aesthetic appearance the surface features 34 have on the overall luggage case 2.

Figure 8:
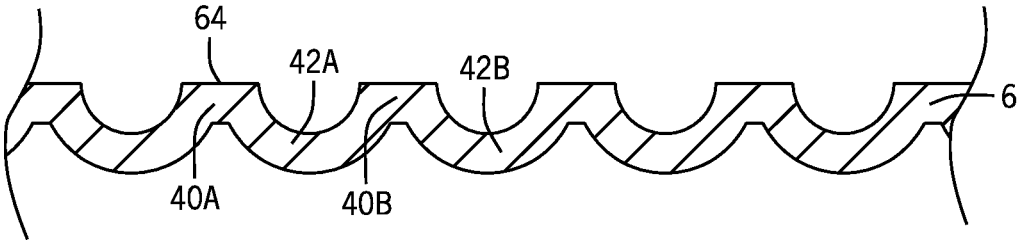
FIG. 8 is a representative fragmentary cross-sectional view of alternative surface features formed by the outer layer of a luggage case in accordance with some examples of the present disclosure.
Figure 9:
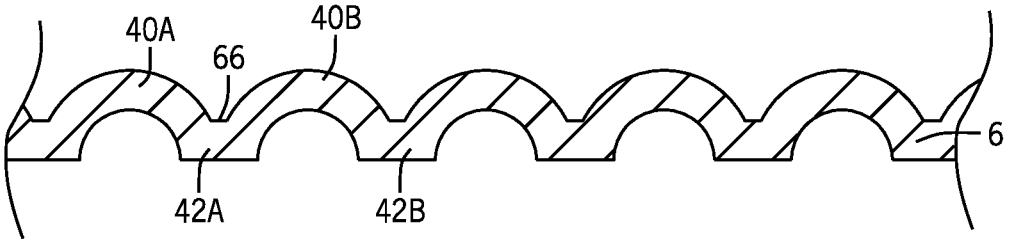
FIG. 9 is a representative fragmentary cross-sectional view of alternative surface features formed by the outer layer of a luggage case in accordance with some examples of the present disclosure.

Referring now to FIGS. 8 and 9, alternative embodiments of the surface features 34 are shown that achieve the same or similar results as discussed above. These structures have different characteristics regarding absorbing and mitigating the impact force F on the apex region 36. In general, the structures of FIGS. 8 and 9 will be stiffer and less resilient, but will still adequately absorb and mitigate impact forces F on the apex region 36. The details regarding specific and relative (based on location and orientation relative to the apex region) width, height, length, and curvature of these alternative rib and groove surface feature structures are substantially the same as or identical to those details described above for the surface features 34 (or surface feature sets 44) shown in FIGS. 1-7. With reference to FIG. 8, the top extent of the first rib 40A and the second rib 40B may define a generally planar nominal surface 64. In such examples, the first groove 42A with a rounded bottom is adjacent the first rib 40A and the second groove 42B with a rounded bottom is adjacent the second rib 40B, and both may extend inward a height dimension (depth) from the nominal surface 64. The nominal surface 64 may not be flat, but instead may be rounded or angled.

With reference to FIG. 9, in other embodiments, the bottom extent of the first adjacent groove 42A and the second adjacent groove 42B may define a generally planar nominal surface 66. In such examples, the first rib 40A with a rounded top and the second rib 40B with a rounded top may extend upward a height dimension from the nominal surface 66. The nominal surface 66 may not be flat, but instead may be rounded or angled.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as not limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A luggage article comprising:

a housing at least partially formed with an outer layer and defining a first shell pivotally connected to a second shell and the shells together defining an interior storage volume, and at least the first shell defining a first side, a second side, and a third side;

at least one corner region defined at an intersection of the first, second, and third sides;

an apex region defined at least partially by the at least one corner region;

at least one first elongated surface feature molded into at least the first shell; and at least one second elongated surface feature molded into at least the first shell, wherein:

the at least one first elongated surface feature extends at least partially across the first side, the second side and the third side at a first distance spaced away from the apex region and curving relative to the apex region; and the at least one second elongated surface feature extends at least partially across the first side, the second side and the third side at a second distance spaced away from the apex region and curving relative to the apex region; and each of the at least one first surface feature and the at least one second surface feature defines a similar curve along a portion of its respective length; and each of the at least one first surface feature and the at least one second surface feature extends generally in a curved shape around the corner region.

2. The luggage article of claim 1, wherein:

the first and second shells of the housing are selectively secured together at a line of closure; and wherein the first shell is formed at least partially by the outer layer.

3. The luggage article of claim 1, wherein the at least one second surface feature is spaced further away from the apex region than the at least one first surface feature.

4. The luggage article of claim 1, wherein:

the at least one first surface feature has a width and the at least one second surface feature has a width; and the width of the surface feature positioned further from the apex region is greater than the width of the surface feature positioned closer to the apex region.

5. The luggage article of claim 1, wherein:

the at least one first surface feature has a height dimension;

the at least one second surface feature has a height dimension; and the height dimension of the surface feature positioned further from the apex region is less than the height dimension of the surface feature positioned closer to the apex region.

6. The luggage article of claim 1, wherein:

the at least one first surface feature includes at least another first surface feature;

the at least one second surface feature includes at least another second surface feature; and the spacing between the at least one first surface feature and the another first surface feature are multiples less than the spacing between the at least one second surface feature and the another second surface feature.

7. The luggage article of claim 1, wherein:

a density of a plurality of the at least one first surface features positioned near the apex region is greater than a density of a plurality of the at least one second surface features distally spaced from the apex region.

8. The luggage article of claim 1, wherein a line of closure extends along a portion of the second side and the third side and at least one of the first surface feature and the second surface feature extends at least partially at generally right angles to the line of closure, or substantially perpendicular to the line of closure.

9. The luggage article of claim 4, wherein the at least one first surface feature and the at least one second surface feature include at least a rib, or include at least a groove.

10. The luggage article of claim 4, wherein:

the at least one first surface feature is defined by a first surface feature set; and the at least one second surface feature is defined by a second surface feature set.

11. The luggage article of claim 1, wherein the at least one first surface feature and the at least one second surface feature curve concave toward, convex away, or in opposite directions relative to the apex region.

12. The luggage article of claim 1, wherein one of the at least one first surface feature or the at least one second surface feature extends along but spaced away from an edge formed by an intersection of any two of the first, second or third sides.

13. The luggage article of claim 1, wherein at least one of the at least one first surface feature and the at least one second surface feature extends for at least a portion of its length across at least one of the first, second or third sides in a direction diagonal relative to the corner region.

14. The luggage article of claim 13, wherein at least portions of at least one of the at least one first surface feature or the at least one second surface feature extend in a direction substantially perpendicular to a component line of an impact force applied at the apex region.

15. The luggage article of claim 14, wherein the component line lies in a range of angles measured from a line extending from an upper corner region diagonally to a lower corner region together formed on a same side, and including a deviation of approximately 10 degrees towards a short side of the housing adjacent the upper corner region, and including a deviation of 20 degrees towards a long side of the housing adjacent the upper corner region.

16. The luggage article of claim 1, wherein each of the at least one first surface feature and at least one second surface feature extends generally in a curved shape around the corner region.

17. The luggage article of claim 1, wherein at least one third elongated surface feature is molded into at least the second shell; and at least one fourth elongated surface feature is molded into at least the second shell.

18. The luggage article of claim 16, wherein the at least one fourth surface feature is spaced further away from the apex region than the at least one third surface feature.

19. The luggage article of claim 17, wherein:

the at least one third surface feature has a width and the at least one fourth surface feature has a width; and the width of the surface feature positioned further from the apex region is greater than the width of the surface feature positioned closer to the apex region.

* * * * *